United States Patent [19]

Ravenelle

[11] 4,312,549

[45] Jan. 26, 1982

[54] MOUNTING ARRANGEMENT FOR A SEWING MACHINE

[76] Inventor: Lucien Ravenelle, 187 Saint Francois St., St. Pie de Bagot, Prov. of Quebec, Canada

[21] Appl. No.: 131,202

[22] Filed: Apr. 24, 1980

[51] Int. Cl.[3] ..... A47B 81/00; D05B 75/00

[52] U.S. Cl. ..... 312/21; 312/23; 312/26; 112/217.1

[58] Field of Search ..... 312/21, 22, 23, 26, 312/30, 29, 237; 112/217.1

[56] References Cited

U.S. PATENT DOCUMENTS

| | | | |
|---|---|---|---|
| 418,522 | 12/1889 | Kiefer | 312/21 |
| 1,421,564 | 7/1922 | Reche | 312/24 |
| 2,409,758 | 10/1946 | Hohmann et al. | 312/30 |
| 2,790,689 | 4/1957 | Hubbell | 312/21 |
| 3,823,993 | 7/1974 | Kakishima et al. | 312/21 |
| 4,089,573 | 5/1978 | Aeschliman | 312/21 |
| 4,111,503 | 9/1978 | Kohara | 112/217.1 |
| 4,135,463 | 1/1979 | Lacasse | 312/29 |
| 4,226,486 | 10/1980 | Roberts et al. | 312/21 |

FOREIGN PATENT DOCUMENTS

| | | | |
|---|---|---|---|
| 1328532 | 4/1963 | France | 112/217.1 |
| 368897 | 3/1932 | United Kingdom | 312/29 |

*Primary Examiner*—Victor N. Sakran

[57] ABSTRACT

A mounting arrangement for a sewing machine is disclosed, comprising a cabinet having an aperture in its top plate, a base plate on which a sewing machine is rigidly secured and an elongated narrow plank member pivoted to the base plate and to an edge of the top plate aperture. The plank member links the base plate to the cabinet. Supports and a locking device retains the assembly of the base plate and plank member in three positions: a top position in which the base plate and plank member are coplanar and level with the top plate to maintain the sewing machine in a free arm position; an intermediate position in which the plank member extends downwardly and vertically from the top plate and the base plate is horizontal to maintain the sewing machine in a flat bed position, and a lower position in which both the plank member and the base plate extend downwardly to maintain the sewing machine in stored tilted position within the cabinet.

7 Claims, 6 Drawing Figures

MOUNTING ARRANGEMENT FOR A SEWING MACHINE

FIELD OF THE INVENTION

This invention relates to a mounting mechanism for sewing machines normally provided with an arm for sewing the cylindrical portions of garments, and which allows an operator to use such machines in both "flat bed" and free-arm positions in addition to enable storing of the machine within its cabinet.

BACKGROUND OF THE INVENTION

Various mechanisms have been provided to enable a sewing machine operator to operate a sewing machine alternately in a free-arm or "flat bed" position as desired. These mechanisms are generally complicated and expensive to manufacture. U.S. Pat. No. 4,135,463 is an improvement over the previous art. The present invention is a further refinement over the known art.

OBJECTS OF THE INVENTION

It is a prime object of the present invention to provide a mounting mechanism for a sewing machine which is very simple in design and construction.

It is another object of the present invention to provide a mounting mechanism which is very easily operated and which is safe especially for children.

SUMMARY OF THE INVENTION

The mounting arrangement, in accordance with the invention, comprises a flat base plate on which the sewing machine is fixedly mounted. One side of the base plate is pivotally secured to one longitudinal edge of a relatively narrow and elongated plank member. This plank member is in turn pivotally secured at its other longitudinal edge to the edge of the normal aperture made in the top plate of the sewing machine cabinet in which the mounting mechanism is located.

Supports and indexing locking means are provided to selectively retain the assembly of the base plate and plank member in three positions corresponding to the free-arm position, the "flat bed" position and the storage position of the sewing machine. In the first position, the plank member and the base plate are substantially flush with the top plate of the cabinet; in the second position, the plank member is generally vertical and supports the base plate in a lower horizontal position; and in the third position, both the plank member and base plate hang down within the cabinet at an oblique angle to the top plate.

The above will be more clearly understood by referring to a preferred embodiment of the invention, illustrated by way of the accompanying drawings, in which:

BRIEF DESCRIPTION OF THE DRAWINGS

Like numerals refer to like elements throughout the drawings.

DETAILED DESCRIPTION OF THE INVENTION

Figure 1:
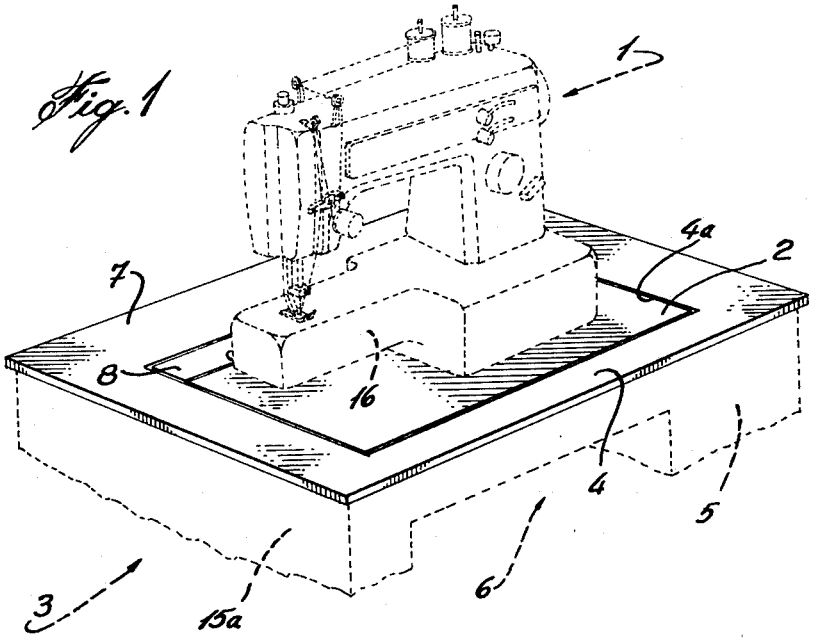
FIG. 1 is a perspective view of the cabinet showing the sewing machine in dashed outline in the first free-arm position.
Figure 2:
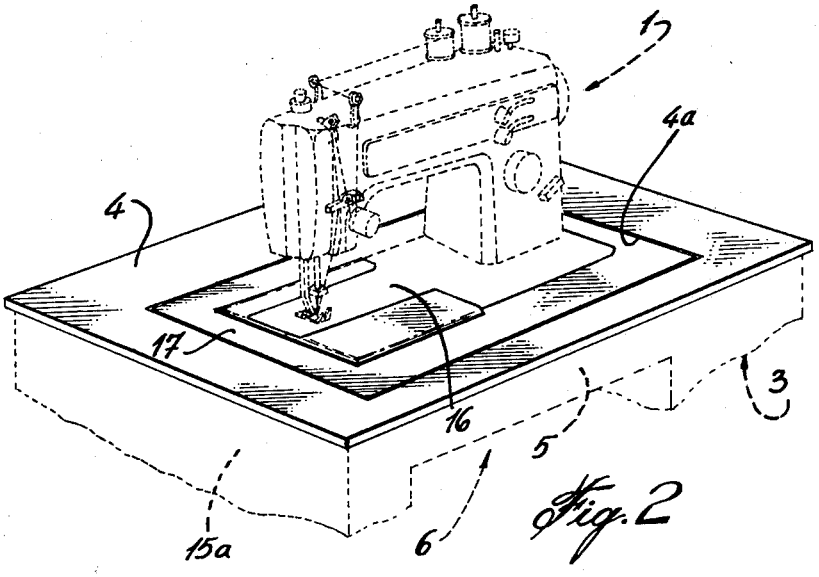
FIG. 2 is a perspective view of the cabinet showing the sewing machine in the second or "flat bed" position.

A conventional sewing machine 1 is rigidly secured to a flat, generally rectangular base plate 2. Base plate 2 is, in turn, pivotally secured in a manner described below to cabinet 3. The latter includes a top plate 4 having the usual rectangular aperture 4*a*, a front side 5, having an opening 6 allowing an operator to be seated in front of sewing machine 1, and a rear side 7. As clearly seen in FIGS. 1 and 2, the sewing machine is laterally aligned.

An elongated plank member 8 is located between the rear longitudinal edge of base plate 2 and the rear longitudinal edge of aperture 4*a*, and is spaced inwardly from the rear side 7 of cabinet 3. Plank member 8 is pivotally secured to the rear longitudinal edge of base plate 2 by means of a piano hinge 8*a* (or any other type of hinge) and to the rear longitudinal edge of aperture 4*a* by means of hinge 8*b*. The pivot axis of hinge 8*a* is level with the top faces of plank member 8 and base plate 2 while the pivot axis of hinge 8*b* is level with the bottom faces of member 8 and top plate 4.

Plank member 8 and base plate 2 fill aperture 4*a* when in a top position wherein they are coplanar with top plate 4 of cabinet 3.

An indexing locking means is provided to selectively lock plank member 8 in one of three positions. This means includes a vertical downwardly-depending flange 9 rigidly secured to the underface of plate 4 one adjacent either end of plank member 8 and across the rear longitudinal edge of aperture 4*a*. Each flange 9 has formed in itself three holes 10, as seen clearly in FIGS. 3–5. A lever shaped shaft 11 projects out of the top surface of plank member 8, is journalled in the latter, and is rigidly secured at its inner end to a double crank bar 12 extending at the undersurface of plank member 8. Two rods 13 and 13' are in turn pivotally secured to crank bar 12 and are guided in guides 13*a* secured to the underside of plank member 8 at either end thereof, such that each rod 13, 13' is adapted to extend into and out of one of the three holes 10 of each flange 9. A coil spring (not shown) surrounds lever shaft 11 underneath plank 8 and is attached to the latter and to crank bar 12. This spring biases rods 13, 13' towards flanges 9.

Figure 3:
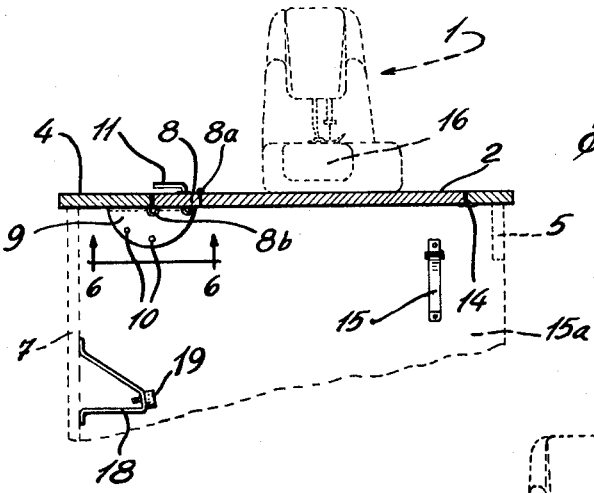
FIG. 3 is a cross-sectional side elevation of the cabinet showing the sewing machine in the first or free-arm position.

It will be clear from the drawings how the mounting mechanism works: FIG. 3 shows the sewing machine in the first or free-arm position wherein plank member 8 and base plate 2 are horizontal and flush with top plate 4 and rods 13 are engaged in the frontmost holes 10 of flanges 9. In this position, the front longitudinal edge of base plate 2 is supported by a pair of spaced lips 14 secured to the undersurface of top plate 4 and protruding rearwardly from the front longitudinal edge of aperture 4*a* of top plate 4.

Figure 4:
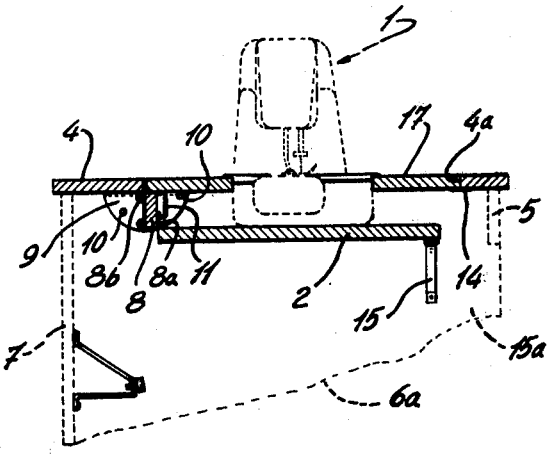
FIG. 4 is a cross-sectional side elevation of the cabinet showing the sewing machine (in dashed outline) in the second or "flat bed" position.
Figure 5:
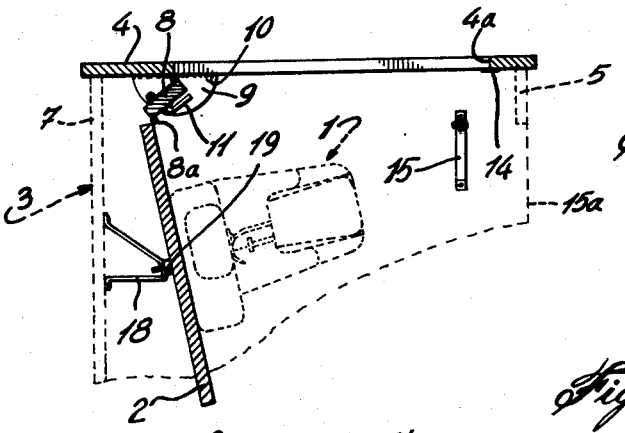
FIG. 5 is a cross-sectional side elevation of the cabinet showing the sewing machine in the third or storage position.
Figure 6:
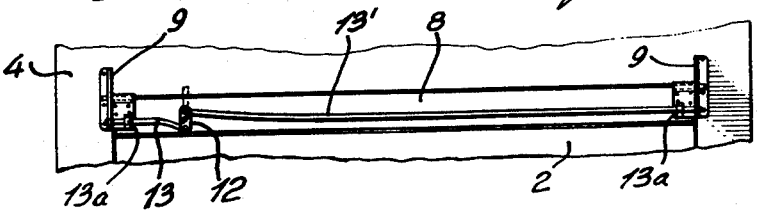
FIG. 6 is a plan view taken along line 6—6 of FIG. 3.

When it is desired to lower sewing machine 1 into the second, or "flat bed" position, the operator simply turns lever 11 to disengage rods 13 from the frontmost holes 10 in each flange 9 and then lowers the sewing machine by hand until it occupies the "flat bed" position shown in FIG. 4. In this position, base plate 2 is below top plate 4 and rests in horizontal position at its front portion on a pair of support brackets 15 secured to the inside of cabinet side walls 15*a*. The arm 16 of sewing machine 1 is flush with top plate 4. The rear side of base 2 is supported by plank member 8, since it is pivoted thereto, and the former is substantially vertical.

To fill the gap left by the base 2 when it is in the second position, a perimetrically-shaped plate 17 may simply be fitted into top plate aperture 4*a* such that it rests on lips 14 and on the rear edge of plank member 8, providing a flat surface to work on.

In order to store sewing machine 1, lever 11 is again operated to free rods 13 from their associated flanges 9. Sewing machine 1 is then pushed rearwardly until the front side of base 2 clears support brackets 15; then it is dropped to the position shown in FIG. 5, wherein base 2 rests against an abutment bracket 18 secured to rear wall 7, and rods 13 are engaged in the rearmost holes 10 of flanges 9. In the storage position, the aperture 4*a* in top plate 4 is covered by a pivoted panel which is conventional and not shown. In order to fit cabinets of different sizes, abutment bracket 18 has an adjustable stop 19 and similarly support brackets 15 can be longitudinally adjusted at their top leg 15*a*.

Although the invention has been disclosed with reference to a preferred embodiment thereof, it is to be understood that it is not limited by such embodiment; for example, the indexing means may vary.

What I claim is:

1. A mounting arrangement for a sewing machine comprising a cabinet having a top plate, a front wall, a rear wall and side walls, said top plate having a generally rectangular aperture longitudinally extending intermediate said front and rear walls, an elongated narrow plank member pivotally secured at its rear longitudinal edge to the rear longitudinal edge of said aperture of said top plate, a flat base plate adapted to fill said aperture in combination with said plank member, said base plate serving as a support for a sewing machine having a free arm and fixed to said base plate with said free arm spaced upwardly from the top surface of said base plate, said base plate being pivotally secured along its rear longitudinal edge to the front longitudinal edge of said plank member, the assembly of the base plate and plank member capable of taking three positions namely a top position in which the base plate and plank member are substantially coplanar and level with the top plate to maintain the sewing machine in a free arm position, an intermediate position in which the plank member extends downwardly and substantially vertically from the top plate and the base plate is generally horizontal to maintain the sewing machine in a flat bed position and a lower position in which both the plank member and the base plate extend downwardly to maintain the sewing machine in a stored position within the cabinet, sand further including first support means to engage the front portion of said base plate in its first position, second support means to maintain the front portion of said base plate in its intermediate position and indexing locking means to removably and selectively lock said plank member to said top plate in its top position and in its intermediate position respectively.

2. A mounting arrangement as defined in claim 1, wherein said first support means include lips secured to the underside of said top plate and protruding rearwardly from the front longitudinal edge of said top plate aperture to support the front edge portion of said base plate in its top position.

3. A mounting arrangement as claimed in claim 2, wherein said second support means include a support bracket secured to the inside of a side wall of said cabinet in a position to engage the front corner of said base plate when in its intermediate position.

4. A mounting arrangement as claimed in claim 3, wherein said indexing locking means further includes means to removably lock said plank member in said lower position wherein said plank member extends downwardly and rearwardly with respect to said top plate and further including an abutment bracket secured to the inside of the rear wall of said cabinet and engaging said base plate in said lower position to retain said base plate in downwardly and forwardly tilted position.

5. A mounting arrangement as claimed in claim 4, wherein said support and abutment brackets are adjustable to suit cabinet sizes of various dimensions and yet support and retain said base plate in its intermediate and in its lower position respectively.

6. A mounting arrangement as claimed in claims 1, 2 or 3, wherein said indexing locking means includes a lever shaft journalled through said plank member and projecting from the top surface of the same, a double crank bar secured to said lever shaft at the underface of said plank member, a pair of elongated rods pivotally connected at one end to the outer ends respectively of said double crank bar, a pair of downwardly depending flanges rigidly secured to the underface of said top plate across the rear longitudinal edge of said top plate aperture at either end thereof, each flange provided with three holes corresponding to the top position, the intermediate position and the lower position of said plank member respectively, said rods being actuable by said lever shaft to extend into and out of the associated holes of each flange when said plank member is in the corresponding position.

7. A mounting arrangement as claimed in claims 1, 2 or 3, further including a perimetrically-shaped plate surrounding the sewing machine, fitting within said top plate aperture and removably resting on said first support means and on the rear edge of said plank member, being flush with said top plate, when said plank member and base plate are in their intermediate position.

* * * * *